US009463141B2

(12) United States Patent
Vaserman

(10) Patent No.: US 9,463,141 B2
(45) Date of Patent: Oct. 11, 2016

(54) INFLATABLE CONTAINER FOR FEEDING BABIES

(75) Inventor: Elchanan Vaserman, Jerusalem (IL)

(73) Assignee: Elchanan Vaserman, Jerusalem (IL)

( * ) Notice: Subject to any disclaimer, the term of this patent is extended or adjusted under 35 U.S.C. 154(b) by 1555 days.

(21) Appl. No.: 11/920,984

(22) PCT Filed: May 14, 2006

(86) PCT No.: PCT/IL2006/000568

§ 371 (c)(1),
(2), (4) Date: Nov. 21, 2007

(87) PCT Pub. No.: WO2006/029302

PCT Pub. Date: Dec. 7, 2006

(65) Prior Publication Data

US 2009/0314735 A1 Dec. 24, 2009

(30) Foreign Application Priority Data

May 30, 2005 (IL) ..... 168871
Apr. 26, 2006 (IL) ..... 175213

(51) Int. Cl.
*A61J 9/00* (2006.01)
*A61J 11/00* (2006.01)

(52) U.S. Cl.
CPC ..... *A61J 9/005* (2013.01); *A61J 11/002* (2013.01)

(58) Field of Classification Search
CPC ..... A61J 11/002; A61J 9/00; A61J 11/0005; A61J 9/006; A61J 11/001
USPC ..... 215/11.4, 11.1, 11.5, 11.6; 224/148.6, 224/148.5, 603, 602
See application file for complete search history.

(56) References Cited

U.S. PATENT DOCUMENTS 4,323,067 A * 4/1982 Adams ..... A61M 1/06 604/346
4,629,080 A * 12/1986 Carveth ..... A61J 9/00 206/219
4,705,504 A * 11/1987 Viers ..... A61M 1/06 604/346
4,754,887 A 7/1988 Ou
4,828,126 A 5/1989 Vincicguerra
4,928,836 A 5/1990 Wu et al.
5,474,193 A * 12/1995 Larsson et al. ..... 215/11.4

(Continued)

FOREIGN PATENT DOCUMENTS

DE 10029711 4/2001
EP 1885321 A2 2/2008

(Continued)

OTHER PUBLICATIONS

Japanese Office Action File No. 5863-IL, 4 pgs., and English Translation thereof 4 pgs.

*Primary Examiner* — Fenn Mathew
*Assistant Examiner* — Cynthia Collado

(57) ABSTRACT

The invention provides an elastomeric expandable container 10 having a first opening 12 adapted to enable the introduction of a comestible fluid 16 under pressure to inflate the same, and a second opening 20 provided in a nipple-like projection 22 extending from said container 10 and adapted for nursing babies, said second opening 20 being closed by valve means 24, and said valve means 24 being opened and closed by the natural nursing actions of the baby to enable fluid 16 to flow under pressure of the inflated container 10 through said nipple 22 and out of the opening 20 thereof.

2 Claims, 5 Drawing Sheets

(56) References Cited

U.S. PATENT DOCUMENTS

| | | | | |
|---|---|---|---|---|
| 5,607,074 | A | 3/1997 | De Gennaro | |
| 5,791,503 | A | 8/1998 | Lyons | |
| 5,947,427 | A * | 9/1999 | Holmquist | A61J 9/001 215/11.1 |
| 6,062,419 | A * | 5/2000 | Kruger | B65D 47/248 220/711 |
| 6,669,064 | B2 * | 12/2003 | Perricone | A61J 9/001 215/11.3 |
| 6,681,944 | B1 * | 1/2004 | Youssef | A61J 9/005 215/11.1 |
| 6,793,094 | B2 * | 9/2004 | Turnbough | A47G 19/2272 215/11.1 |
| 6,923,337 | B2 * | 8/2005 | Hession | B65D 47/2018 215/388 |
| 7,204,380 | B2 * | 4/2007 | Webb | A47G 19/2272 137/843 |
| 7,351,251 | B2 * | 4/2008 | Garrett | A61J 17/00 606/236 |
| D584,399 | S * | 1/2009 | Pacini | D24/109 |

FOREIGN PATENT DOCUMENTS

| | | |
|---|---|---|
| JP | 44-31519 | 12/1969 |
| JP | 61-22863 | 1/1986 |
| JP | 05-68542 | 9/1993 |

* cited by examiner

Fig. 3
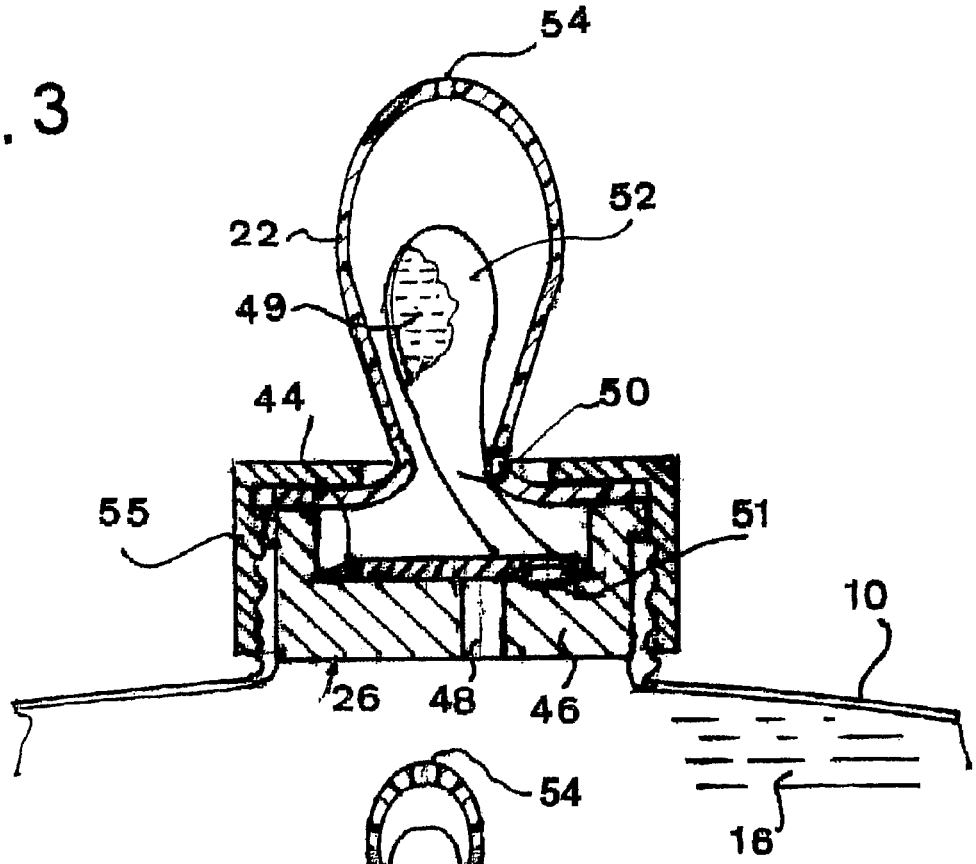
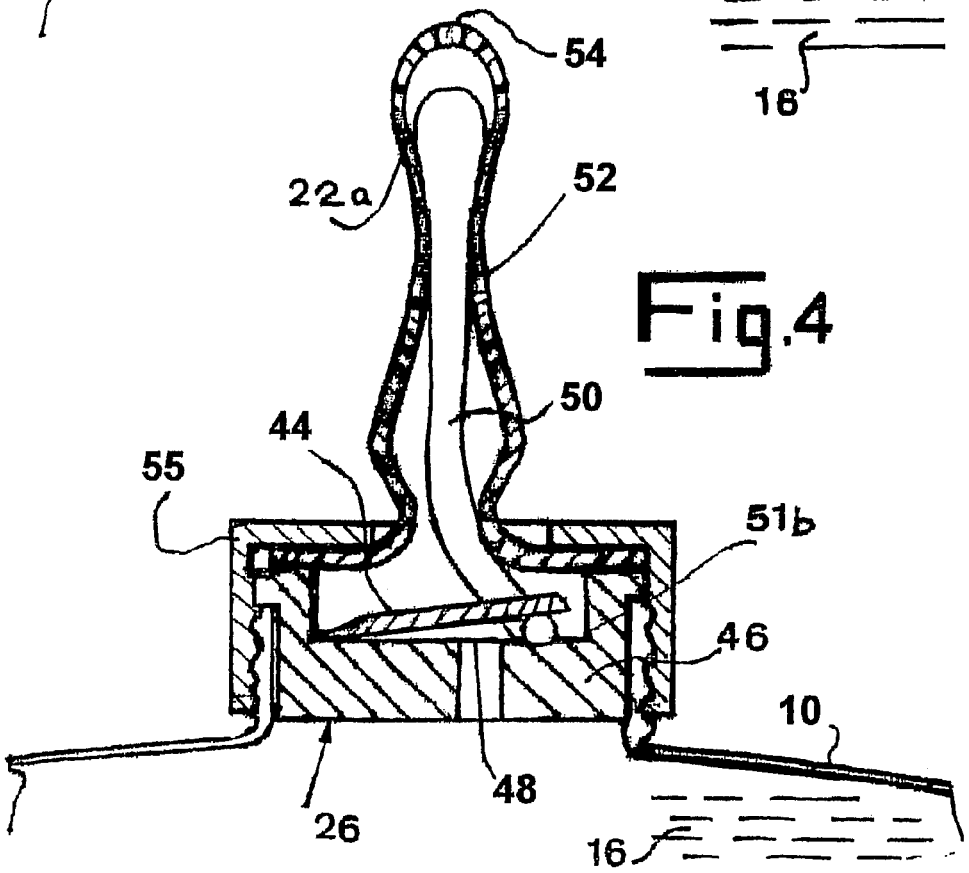
Fig. 4

Fig. 7
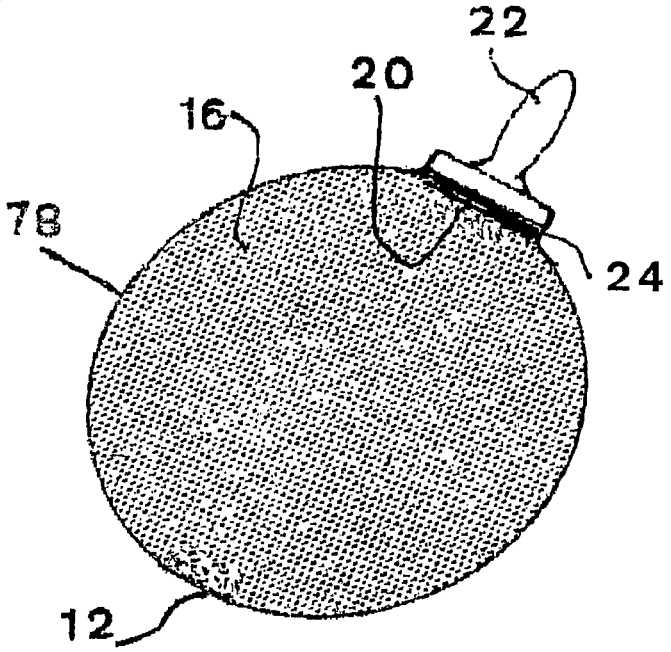
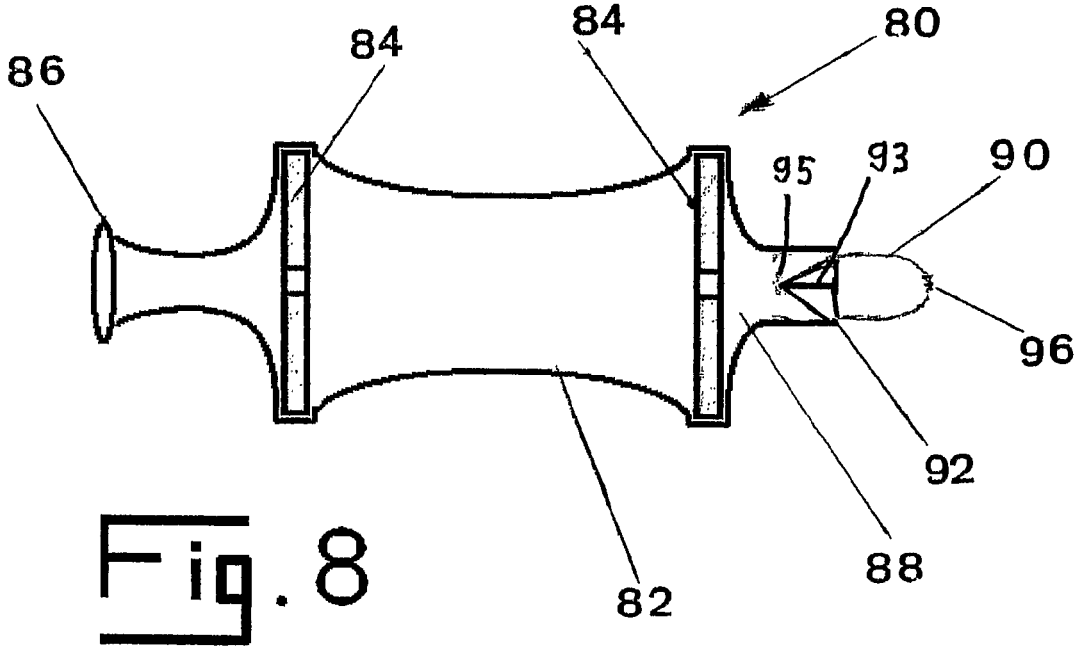
Fig. 8

INFLATABLE CONTAINER FOR FEEDING BABIES

The present invention relates to an inflatable container for feeding babies and infants.

More particularly, the invention provides an inflatable container which includes a conventionally-shaped nipple and which eliminates the need to allow air ingress as the fluid held therein is consumed.

Presently all baby bottles known to the inventor are rigid or flexible thick-wall containers, provided with a removable nipple for the nursing baby or infant. For use the bottle needs to be axially, at least horizontal and when near empty needs to be held at an angle to the horizontal with the nipple pointing downwards. Some arrangement is necessary to allow air to enter the bottle as the liquid is consumed.

The nursing baby usually ingests some of the air accumulating above the liquid level of the nutritional fluid in the bottle and after feeding, the baby needs to be held and "burped" to release said air from the digestive tract.

A patent search revealed no disclosures directly relevant to the present invention, where the volume of a thin-wall container is expanded by the pressurized liquid contained therein. However the state of the art with regard to baby feed bottles is well represented by a review of the following patents.

In U.S. Pat. No. 4,754,887 Ou discloses a nursing bottle including a partition board provided with an elongated pipette and a valved partition board, the aim being to allow the infant to suck the contained fluid while lying or sitting.

Vincinguerra discloses a baby bottle having an inlet valve in U.S. Pat. No. 4,828,126. The valve and the nipple are retained by identically screw-on fixtures at opposite ends of the bottle.

A baby bottle provided with an air inlet valve at its side is described and claimed by Wu et al. in U.S. Pat. No. 4,928,836. A valve in an air-pressure-sensitive compartment opens under low bottle pressure, which moves a diaphragm.

The baby bottle described and claimed by De Gennaro in U.S. Pat. No. 5,607,074 has an air inlet valve responsive to pressure in the bottle, admitting air as the baby sucks.

The same end is achieved by Lyons in U.S. Pat. No. 5,791,503 using a partially sealable check valve between the bottle top and the nipple.

Patent no. DE 10029711 describes an insulating cover for a feeding body which can be inflated. However the bottle used therewith is not expandable.

There are large inflatable baby bottles commercially available from various manufacturers, but these are non-functional and are intended for clowns, actors and general entertainment and are totally unconnected with the subject of the present invention.

Prior art baby bottles all allow air ingress, although the method of doing so varies greatly. In the conventional bottle air enters through the same nipple orifice used by the comestible fluid. As the baby drinks, some of the air in the bottle enters the stomach causing discomfort and requiring its release by holding the baby upright and gently but repeatedly patting the back of the baby.

Furthermore, the nipple of the conventional bottle needs to be horizontal or near horizontal so that the comestible fluid enters the nipple. After most of the comestible fluid has been consumed, the bottle needs to be orientated at a nipple-down slope.

It is therefore one of the objects of the present invention to obviate the disadvantages of prior art baby feed bottles and to provide a container which is expanded by the pressurized fluid feed contained therein.

It is a further object of the present invention to provide a baby feed bottle which can be used in any orientation.

Yet a further object is the substantial elimination of air inside the bottle to eliminate air inlet valves and to substantially reduce the need for "burping" the baby.

The present invention achieves the above objects by providing an elastomeric expandable container having a first opening adapted to enable the introduction of a comestible fluid under pressure to inflate the same, and a second opening provided in a nipple-like projection extending from said container and adapted for nursing babies, said second opening being closed by valve means, and said valve means being opened and closed by the natural nursing actions of the baby to enable fluid to flow under pressure of the inflated container through said nipple and out of the opening thereof.

In preferred embodiments the present invention provides a balloon-like elastomeric inflatable container having a first opening adapted to enable the introduction of a comestible fluid under pressure to inflate the same, and a second opening provided in a nipple-like projection extending from said container and adapted for nursing babies, said second opening being closed by valve means, and said valve means being opened and closed by the natural nursing actions of the baby.

In a preferred embodiment of the present invention there is provided a balloon-like elastomeric inflatable container wherein said valve means comprises two inter-engaging elements wherein at least one of said elements is provided with an aperture facing said nipple-like projection and wherein a sealed, partially fluid-filled pneumatic or hydraulic actuating means is positioned between said elements and extends through said aperture into said nipple, the arrangement being such that a squeezing action on the nipple by a nursing baby displaces fluid within said actuating means to pneumatically or hydraulically separate said two elements and to enable fluid to flow under pressure of the inflated container through said nipple and out of the opening thereof.

In another preferred embodiment of the present invention there is provided a balloon-like elastomeric inflatable container, wherein said valve means comprises two inter-engaging elements wherein at least one of said elements is provided with an aperture facing said nipple-like projection and wherein a sucking action on the nipple by a nursing baby reduces pressure on the element sealing said aperture to pneumatically or hydraulically separate said two elements and to enable fluid to flow under pressure of the inflated container through said nipple and out of the opening thereof.

In the present invention said first opening is adapted to enable the introduction of a comestible fluid under pressure by the inclusion therein of a first valve which is of the one-way type and thus allows the introduction of a comestible fluid under pressure to inflate the container.

In a further preferred embodiment of the present invention there is provided a balloon-like elastomeric inflatable container, wherein said liquid is milk.

In a further preferred embodiment of the present invention there is provided a balloon-like elastomeric inflatable container in combination with pump means for introducing said liquid into said container under pressure to inflate and fill the same. In yet a further preferred embodiment of the present invention there is provided a balloon-like elastomeric inflatable container which is disposable after use.

In another preferred embodiment of the present invention there is provided a disposable balloon-like elastomeric inflatable container wherein said container is pre-filled with a sterilized comestible fluid for an infant.

In another preferred embodiment of the present invention there is provided a balloon-like elastomeric inflatable container wherein said fluid is baby formula.

It will thus be realized that the novel device of the present invention has many advantages over the conventional baby bottle:

a) there is no need to admit any air into the container as the comestible fluid is consumed;

b) the pressure applied by the inflated container on the comestible fluid makes it easier for the baby to suck;

c) the container can be oriented in any direction during use;

d) the container, in most embodiments, can be transported and stored in the collapsed state;

e) the low weight of the thin-wall container translates into material and cost savings; and f) some embodiments of the invention are provided for babies who primarily suck the tip of the nipple while other embodiments are better for babies who primarily compress the throat of the nipple.

Because of advantages (a) through (e) enumerated above, the container of the present invention can also be used in contexts other than that of feeding babies, for example as a feeding container for astronauts or for invalids or patients who cannot drink liquids in the normal manner.

Thus according to the present invention there is also provided an elastomeric expandable container having a first opening adapted to enable the introduction of a comestible fluid under pressure to inflate the same, and a second opening provided in a nipple-like projection extending from said container and adapted for sucking said comestible fluid from said container, said second opening being closed by valve means, and said valve means being opened and closed by a sucking action of the user to enable fluid to flow under pressure of the inflated container through said nipple and out of the opening thereof.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 3 is a sectional view of a closed fluid-operated outlet valve also attached to the container which is seen in FIG. 1;

FIG. 4 is the same as FIG. 3 showing the valve in the open position;

FIG. 7 is a schematic, non-detailed view of a preferred embodiment of a disposable container;

FIG. 8 is a partly sectioned elevational view of a substantially cylindrical embodiment;

Figure 1:
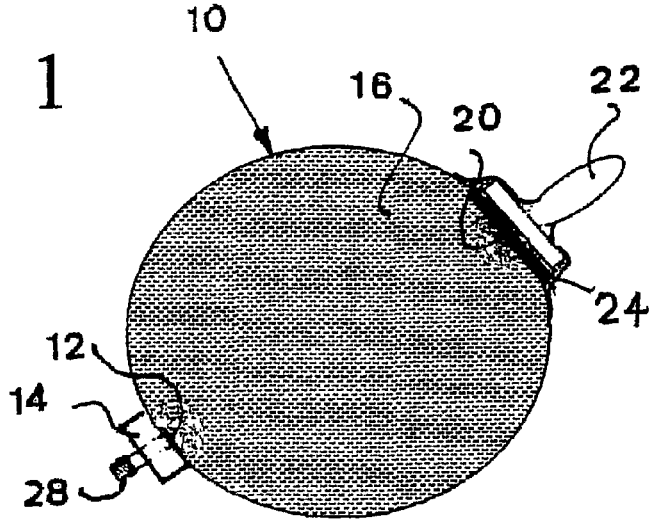
FIG. 1 is a schematic, non-detailed view of a preferred embodiment of the container according to the invention.

There is seen in FIG. 1 a balloon-like elastomeric inflated container 10, preferably made of a rubber, for example a natural rubber.

The container 10 has a first opening 12 including a first valve 14, which is of the one-way type and allows the introduction of a comestible fluid 16 under pressure to inflate the container. The first valve 14 will be seen in detail in FIG. 2

The comestible fluid 16 can be water, a water-sugar solution, milk, baby formula, or fruit juice, depending on the age and tastes of the infant. The first valve 14 is opened by external fluid pressure and firmly closed by a spring 18 when such pressure is no longer applied.

A second opening 20 provided holds a conventional nipple-like projection 22 extending from the container and is adapted for nursing babies. The second opening 20 is closed by a second valve 24 which is operated indirectly by the natural nursing actions of the baby.

A more detailed description of the valves will be provided in following figures.

With regard to the rest of the figures, similar reference numerals have been used to identify similar parts.

Figure 2:
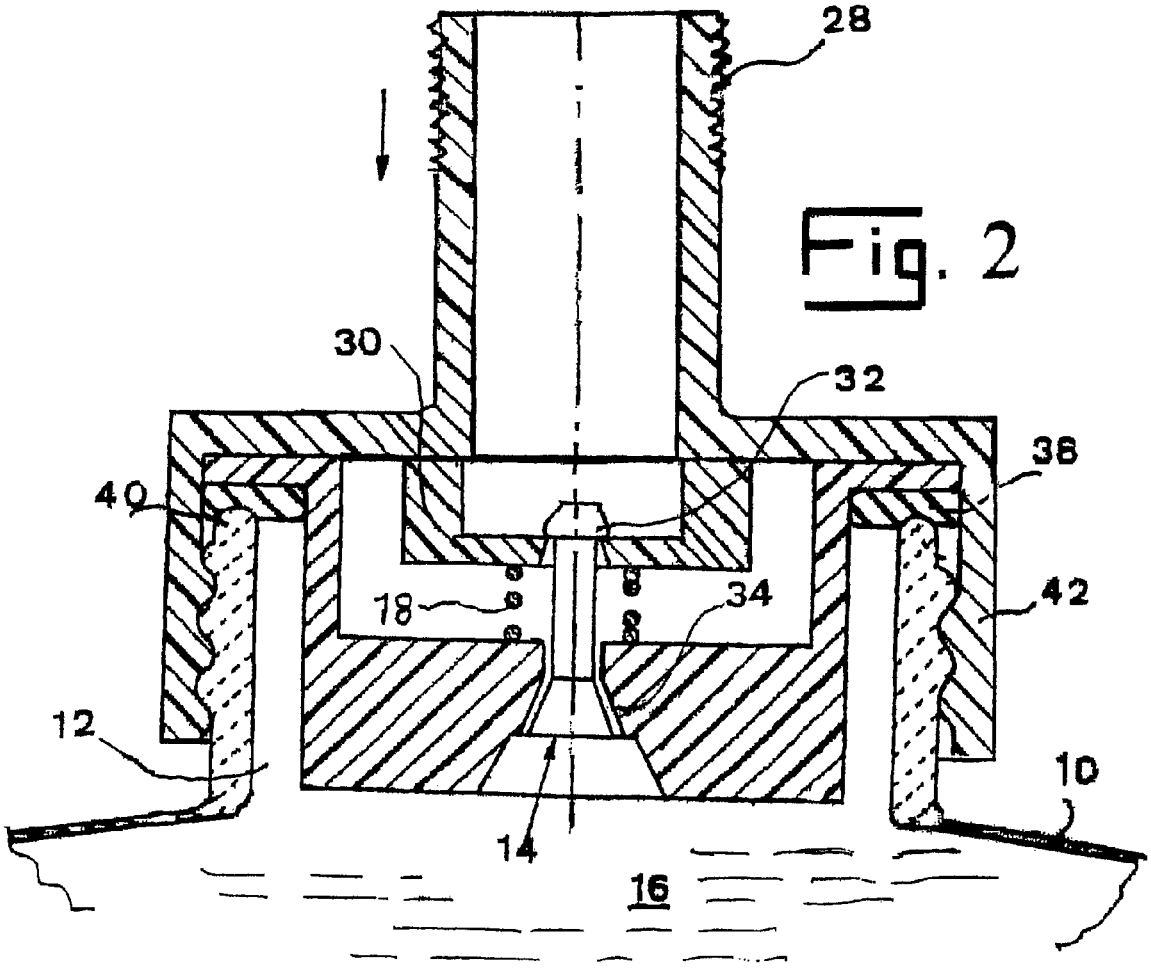
FIG. 2 is a greatly enlarged view of the charging port attached to the container which is seen in FIG. 1.
Figure 6:
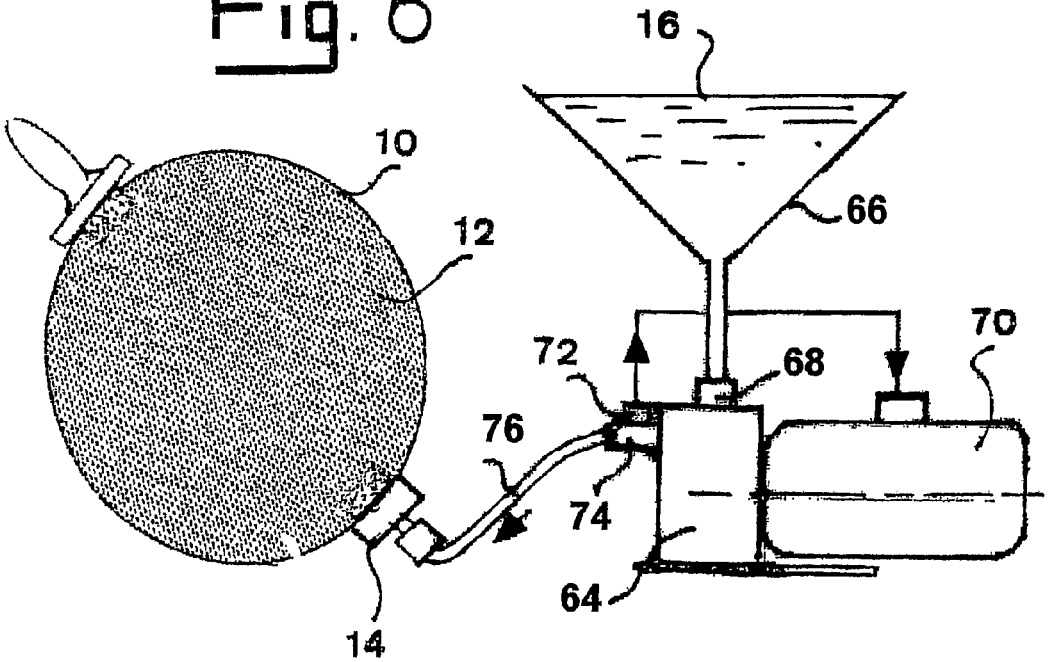
FIG. 6 is a schematic view showing an arrangement allowing recharging an empty container.

FIG. 2 illustrates on a greatly expanded scale the first (inlet) valve 14 allowing filling of the container 10 seen to better effect in FIG. 1. The source of the pressurized feed liquid, an example being seen in FIG. 6, is held to the inlet port 28 by being screwed on. Incoming fluid presses against the U-shaped disk 30 and against the plunger 32, which then move downwards to allow passage for the fluid 16 through the orifice 34. which is inserted in the first opening 12, allowing fluid 16 to enter the container 10.

On removal of external pressure the compression spring 18 moves the plunger 32 to reseal the orifice 34.

A flexible seal washer 38 is seen between the container extremity 40 and the inlet screw-on housing 42.

Turning now to FIGS. 3 and 4 there is seen a second (outlet) valve 26 attached to the inflatable container 10 better seen in FIG. 1.

The present embodiment utilizes the biting action of the baby to open the valve 26.

The valve 26 comprises two inter-engaging elements 44 and 46. In the drawing the upper element 44 is a movable flap, biased downwards and hinged at its left extremity. The lower element 46 is fixed and provided with an aperture 48, which is normally sealed by the upper flap 44 coming into close contact to the edges of the aperture 48.

A first part 51 of a sealed, partially fluid-filled flexible pneumatic actuator 50 is positioned between the two inter-engaging elements 44, 46. A second part 52 of the actuator 50 extends into the nipple 22. The arrangement is such that a squeezing action on the distorted nipple 22*a*, seen in FIG. 4, by a nursing baby displaces fluid within the actuating means 50 to separate the two elements 44, 46 as the first part of the actuator 51 changes from a collapsed state seen in FIG. 3 to the round state 51*b* seen in FIG. 4. This enables fluid 16 to flow under pressure of the inflated container 10 through the nipple 22, 22*a* and out of the nipple opening 54.

As can be seen in FIG. 3 the normal closed position of the upper flat is attained when there is no mechanical pressure on the actuator 50, and the first part 48 is a flat oval.

The actuator 52 is preferably filled with water 49 and leaving a small portion of the inner volume for air or an inert gas. The quantity of gas is just sufficient to allow the valve 26 to close when no external pressure is applied thereto. Thus when the baby releases pressure on the nipple 22, the part of the actuator disposed between the elements is pressed between the closed elements to revert to its flat oval form.

A light spring (not shown) can optionally be added to ensure closure of the valve as seen in FIG. 3.

Figure 5:
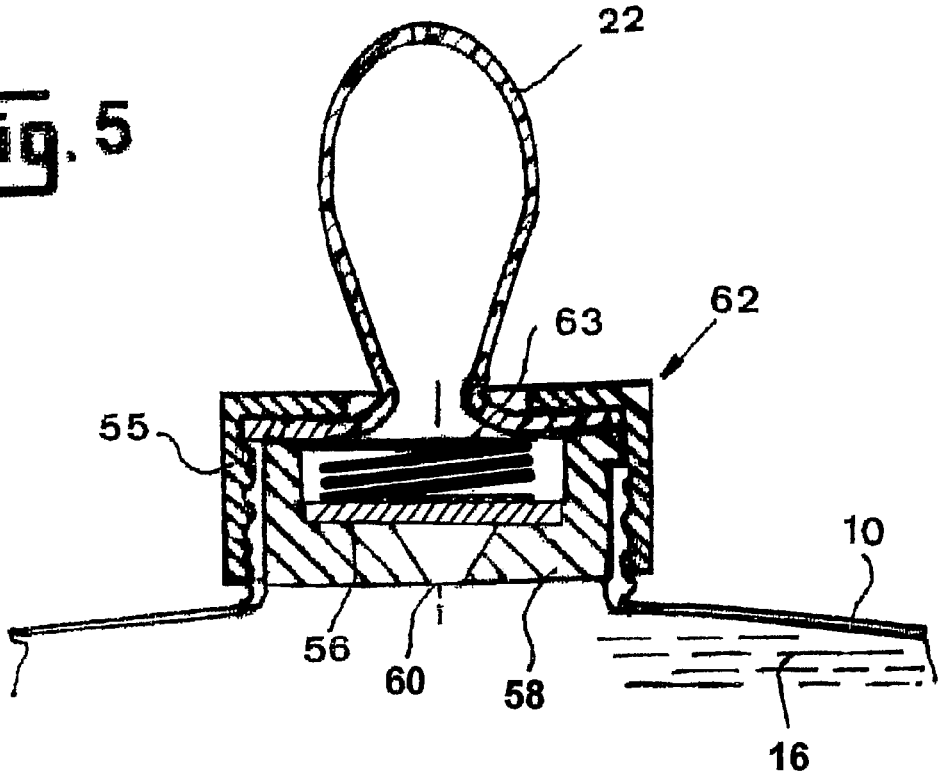
FIG. 5 is a sectional view of a second embodiment of the outlet valve.

Referring now to FIG. 5, there is seen a second embodiment 62 of the second (outlet) valve attached to the inflatable container 10 seen in FIG. 1. The valve 62 comprises two inter-engaging elements 56, 58 wherein the lower element 58 is provided with an aperture 60 facing the nipple-like projection 22.

A sucking action on the nipple 22 by a nursing baby reduces pressure on the upper face of the element 56 which previously had sealed the aperture 60, to lift the element 56 and to enable fluid 16 to flow under pressure of the inflated container 10 through the nipple 22 and out of the nipple opening 54.

A light spring 63 reseats the upper element 56 when suction is no longer applied to the nipple 22.

Seen again in FIG. 6 is the balloon-like elastomeric inflatable container 10 as seen in FIG. 1.

A small plastic pump 64 having a funnel 66 in fluid communication with its inlet port 68 introduces the liquid 16 into the container 10 under pressure to inflate and fill the container 10.

The pump 64 is preferably electrically driven by a small motor 70. Current is supplied to the motor 70 through a pressure switch 72 which cuts off the motor power when inflation pressure reaches the design level.

Capacity of the funnel 66 is advantageously about equal to that of the container 10, which is typically about 250-400 cc.

The output port 74 of the pump 64 is shown connected to the first valve 14 of the container 10 by means of a tube 76. On cessation of pumping the first valve 14 closes to retain the fluid feed 12 and prevent spillage from the container 10. Thereafter the tube 76 is disconnected by the user.

Turning now to FIG. 7, there is depicted a disposable balloon-like elastomeric inflatable container 78 pre-filled with a sterilized comestible fluid 16 for an infant. In the disposable container 78 a first valve is neither needed nor provided. The first opening 12 is hermetically and permanently sealed at the manufacturing factory after filling and inflation of the container 78.

FIG. 8 presents a further embodiment 80 of the baby bottle. A generally cylindrical stretchable container 82 is seen, internally containing a pair of washers 84 which are in face contact with each other when the container is empty. An inlet section 86 allows filling and sealing of the now pressurized container 82, whereafter the inlet 86 is closed. The outlet 88 terminates in a nipple 90, which is sealed by a flexible, normally closed valve 92 in the nipple 94. The valve 92 is conical in shape and divided into three segments 93 with the apex 95 of said cone facing the container 82. The valve 92 opens when transversely compressed, as occurs when the baby closes his/her gums on the nipple and as a result of the sucking action of the baby and/or pressure of the baby's gums or lips on the nipple. The pressurized container 82 causes the contained liquid to exit from the aperture 96 in the nipple extremity and flow continues until the baby releases pressure on the valve 92.

Figure 9:
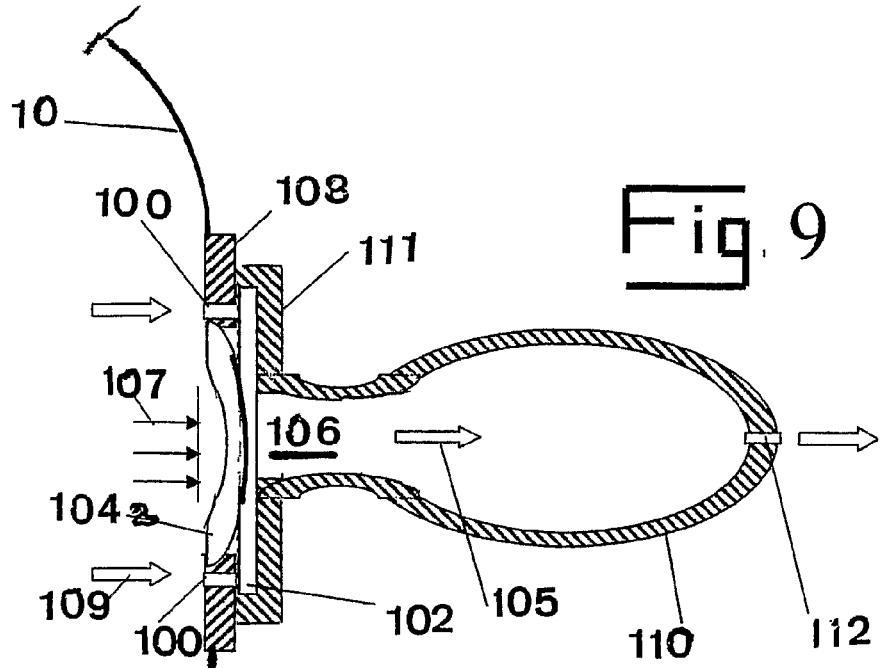
FIG. 9 is a sectional view of part of a further embodiment, shown as feeding the liquid as a result of a baby sucking at the nipple.
Figure 10:
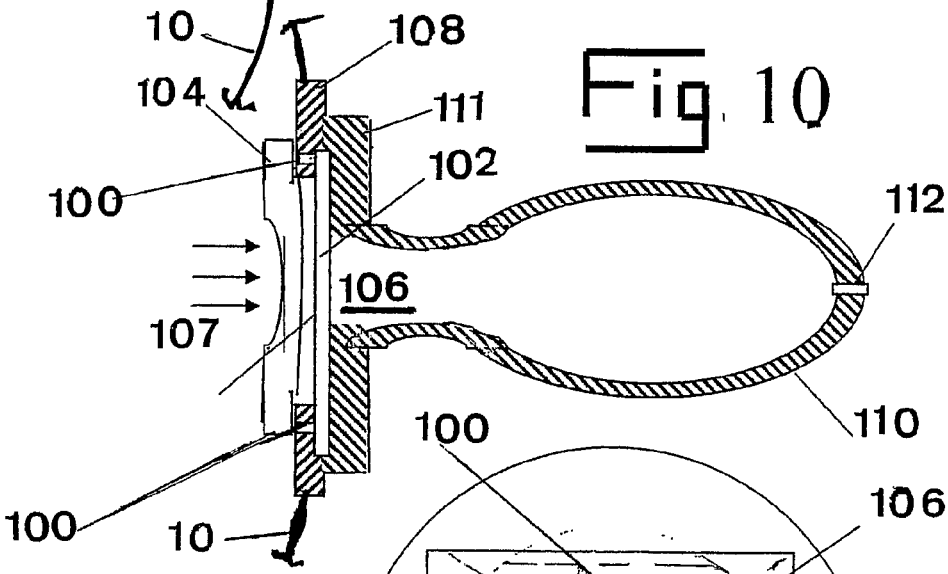
FIG. 10 is the same as FIG. 9, but there is no flow as no suction is applied.
Figure 11:
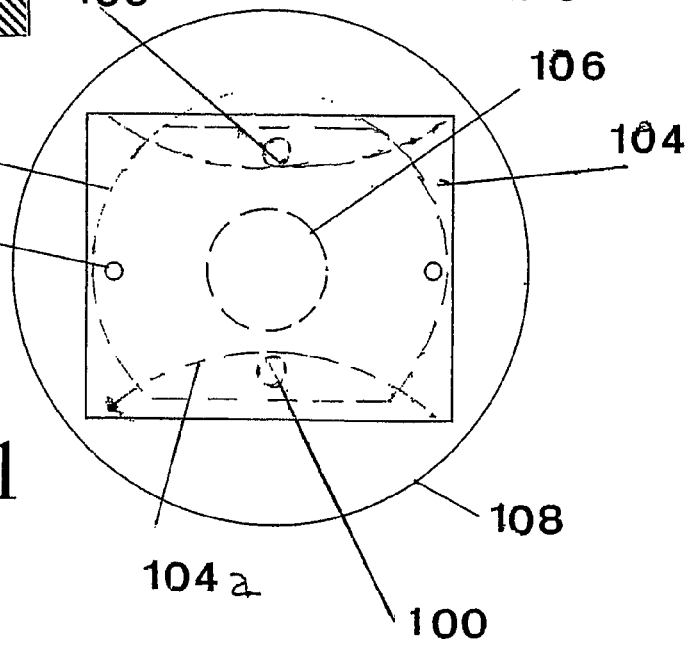
FIG. 11 is an end view of the embodiment seen in FIG. 9.

The container of FIG. 8 can be used in conjunction with a filing stand (not shown) for spreading washers 84 to facilitate the filing of said container. With reference now to FIGS. 9, 10 and 11 there is seen the valve portion of a further embodiment.

A plurality of apertures 100 are connected to a recesses area 102 in a disk 108 at one extremity and to the balloon-like elastomeric inflated container 10, seen in FIG. 1, at the remaining extremity. The apertures 100 are normally covered by a elastomer cover 104, shown in rectangular form. As seen in FIG. 10, no flow can occur through the apertures 100 because inflation pressure holds the cover 104 against the opening of the apertures. When further suction 105 is applied by the nursing baby or infant the cover 104 is distorted **104*a* when drawn further into a central cavity 106 and thus exposes the apertures 100 to the pressurized liquid 106 held in the container 10. Liquid then flows 109 through the apertures 100, into a recessed area 102, through the central cavity 106 in the nipple base 111 and passes through the nipple 110 and out through the nipple orifice 112**.

The elastomer cover 104 shown is retained in position by a plurality of fasteners 114.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A balloon-like elastomeric expandable container, comprising:

a first opening adapted to enable an introduction of a comestible fluid under pressure thereby inflating said elastomeric expandable container, wherein said balloon-like elastomeric expandable container allows for hermetic and permanent sealing of said first opening following filling and inflation of same; and a second opening having a nipple-like projection extending from said balloon-like elastomeric expandable container and adapted for nursing babies, said second opening being closed by a valve means, said valve means being an inverted one-way valve which is opened and closed by natural nursing actions of a baby whereby fluid flow through said nipple-like projection and out of an opening in said nipple-like projection is accomplished while said flow is under pressure, and said valve means comprising two inter-engaging elements wherein at least one of said elements has an aperture facing said nipple-like projection and wherein a sealed, partially fluid-filled compressible and deformable pneumatic or hydraulic actuating means is positioned between said elements and extends into said nipple, an arrangement being such that a squeezing action on said nipple-like projection by a nursing baby displaces fluid within said actuating means to pneumatically or hydraulically separate said two elements and to enable fluid to flow under pressure of an inflated container through said nipple-like projection and out of said opening in said nipple-like projection.

2. A balloon-like elastomeric inflated container, wherein said balloon-like elastomeric inflated container is pre-filled with a sterilized comestible fluid for a baby or an infant through a first opening that is hermetically and permanently sealed after filling and inflation of said elastomeric inflated container, and said elastomeric inflated container is provided with a second opening having a nipple-like projection extending from said balloon-like elastomeric inflated container and adapted for a nursing baby or said infant, said second opening being closed by a valve means, and said valve means being an inverted one-way valve which is opened and closed by natural nursing actions of said nursing baby or said infant.

* * * * *